United States Patent [19]

Burgeson et al.

[11] Patent Number: 5,035,435

[45] Date of Patent: Jul. 30, 1991

[54] ARROW MOUNTED SCENT CARRIER

[75] Inventors: John R. Burgeson, Anoka; John C. Burgeson, Shoreview, both of Minn.

[73] Assignee: Wildlife Research Center, Inc., Anoka, Minn.

[21] Appl. No.: 29,965

[22] Filed: Mar. 25, 1987

[51] Int. Cl.[5] ..... F42B 6/04

[52] U.S. Cl. ..... 273/418; 239/34; 239/56

[58] Field of Search ..... 273/416, 418, 419–423; 239/36, 34, 55, 56

[56] References Cited

U.S. PATENT DOCUMENTS

| | | | |
|---|---|---|---|
| 1,545,476 | 7/1925 | Austerman . | |
| 1,842,540 | 1/1932 | Cowdery | 273/423 |
| 1,999,601 | 4/1935 | Tengel | 273/416 |
| 2,234,062 | 3/1941 | Roberts | 239/36 X |
| 2,560,681 | 7/1951 | Berkowitz | 239/36 X |
| 2,568,919 | 9/1951 | Kaye | 239/55 X |
| 2,617,359 | 11/1952 | Van Horn et al. | 273/418 X |
| 2,851,304 | 9/1958 | Timms | 239/56 |
| 2,959,354 | 11/1960 | Beck | 239/36 |
| 3,046,192 | 7/1962 | Bilyeu | 167/48 |
| 3,150,875 | 9/1964 | Searles | 273/206.5 |
| 3,428,321 | 2/1969 | Manning | 273/423 |
| 3,457,921 | 7/1969 | Waldeisen | 273/418 X |
| 3,565,435 | 2/1971 | Bear | 273/418 |
| 3,614,947 | 10/1971 | Feldman | 273/416 X |
| 3,955,706 | 5/1976 | Whitaker | 239/55 X |
| 4,523,717 | 6/1985 | Schwab | 239/56 |
| 4,609,245 | 9/1986 | Sakschek | 239/36 |

OTHER PUBLICATIONS

Archer's Bible 1966–1967, 3–1967, p. 133, Kittredge Scent Pad.

Gander Mountain, Inc. Outdoor Sportmen Supplies Catalog, Published 1986, prior art seen on p. 76 thereof.

*Primary Examiner*—Paul E. Shapiro

*Attorney, Agent, or Firm*—Palmatier & Sjoquist

[57] ABSTRACT

A hunting scent dispersing device for attachment to the shaft of an arrow. The dispersing device includes an absorbant carrier for retaining and permitting release therefrom of a hunting scent which is to be releasably attached to the arrow.

8 Claims, 1 Drawing Sheet

ARROW MOUNTED SCENT CARRIER

FIELD OF THE INVENTION

The present invention generally relates to devices for dispensing scents, and in particular, to such devices as are used for dispensing scents used as an attractant in the hunting of wild game.

BACKGROUND OF THE INVENTION

Various scent formulations are known and used by hunters as attractants for the particular animal specie they are in pursuit of. Such formulations can include animal urine, animal glandular products and plant derivatives. Such scents are typically designed to stimulate mating or territorial behavior thereby causing the animal to be attracted to the location of the scent. Generally, a hunter will establish a protected position or stand to hunt from, around which he will distribute the scent. Various scent dispensing devices are known, see, for example, U.S. Pat. No. 4,523,717 to Schwab, issued June 18, 1985; U.S. Pat. No. 3,046,192 to Bilyeu, issued July 24, 1962; and U.S. Pat. No. 2,959,354 to Beck, issued Nov. 8, 1960. Such prior art dispensers include absorbent material to hold and permit the slow release therefrom of the scent into the ambient air. Such dispensers require that they be carried by the hunter to the desired location and then hung from a suitable branch or other supporting object. However, in carrying the dispenser to the desired spot the hunter will inevitably leave a human scent trail between the dispenser and the location of his stand, and can make a substantial amount of noise. As a result thereof, the animal being hunted may be prematurely alerted to the hunter's presence, and run off.

A further prior art device for distributing animal scent is known that employs hollow metal pellets containing absorbent material. In use, the absorbent material is saturated with the particular scent afterwhich the pellet is projected, by means of a sling shot, to the desired location from the hunter's stand. However, such pellets will generally land at or near the ground level, and as a result thereof, can easily be covered by leaves or other low lying vegetation thereby reducing the ability of the scent to be released into the ambient air in sufficient quantities to attract an animal.

Accordingly, it would be very desirable for a hunter to be able to distribute the animal attractant in a manner that minimizes the amount of human scent put down in his immediate vicinity, yet provide for the dispersal of an adequate amount of the animal attractant scent into the ambient air.

SUMMARY OF THE INVENTION

It is an object of the present invention to provide for a device that allows for the distribution of effective quantities of animal attractant scent while minimizing the spreading of any unwanted human odors, and the producing of any unnecessary noise.

It is also an object of the present invention to provide for a scent distributing device that is compact and light weight and that can be easily integrated with the hunter's normal complement of equipment.

A feature of the present invention is an absorbent, porous carrier, made preferably of an absorbent felt material. The carrier is sized for attachment to the shaft of an arrow in such a way as to prevent any significant interference with the flight of the arrow. In its preferred form the carrier is approximately two inches long with the width and height thereof approximately the diameter of the shaft of the arrow, generally about five-sixteenths of an inch.

Another feature of the invention is a means for providing attachment of the carrier to the arrow shaft that allows for effective dispersal of the scent and that also does not interfere substantially with the flight of the arrow. The carrier can be permanently secured to the arrow by a variety of attachment means, such as adhesive or tape; however, it is desirable that the carrier be quickly and easily removable therefrom so that the arrow need not be dedicated to use with the carrier. In its preferred form, the scent dispersing device herein uses Velcro® to provide for such releasable attachment. Thus, a small strip of one of the matching surfaces of the Velcro® can be permanently secured to the arrow shaft so as to cooperate the other opposing or mating strip of Velcro® material secured, as by sewing or adhesive, to the felt carrier.

In operation, the carrier is first secured to the shaft of the arrow adjacent the fletching or feathered end thereof and then saturated with the desired scent. The arrow is then shot in a high arc so that it lands in an upright position embedding the head or point end thereof in the ground at the desired distance from the hunter's stand. As a result, the carrier will be held off the ground a sufficient height to be above most low lying vegetation, and thus, to allow good dispersal of the scent into the air. Furthermore, scent distributed in such a manner greatly minimizes the tracking down of unwanted human odors, and thus, the chance that the animal will detect the hunter's presence. In addition, as the carrier is removable from the arrow shaft, and as only a small portion of the Velcro® material is left thereon, the arrow can also be used for hunting, as such Velcro® strip does not appreciably affect the arrow's flight.

Thus, it is a major advantage of the present invention that it allows the effective use of animal attractant scents in hunting without necessitating the unwanted dispersal of the hunter's scent, or the creation of unwanted noise.

It is also an advantage of the present invention that the carrier will generally be held above most low lying vegetation thereby permitting dispersal of the scent into the air and in particular to be carried by any wind that may be present.

It is also an advantage of the present invention that it is small and light weight, and therefore easy for the hunter to carry and use.

DETAILED DESCRIPTION

Figure 1:
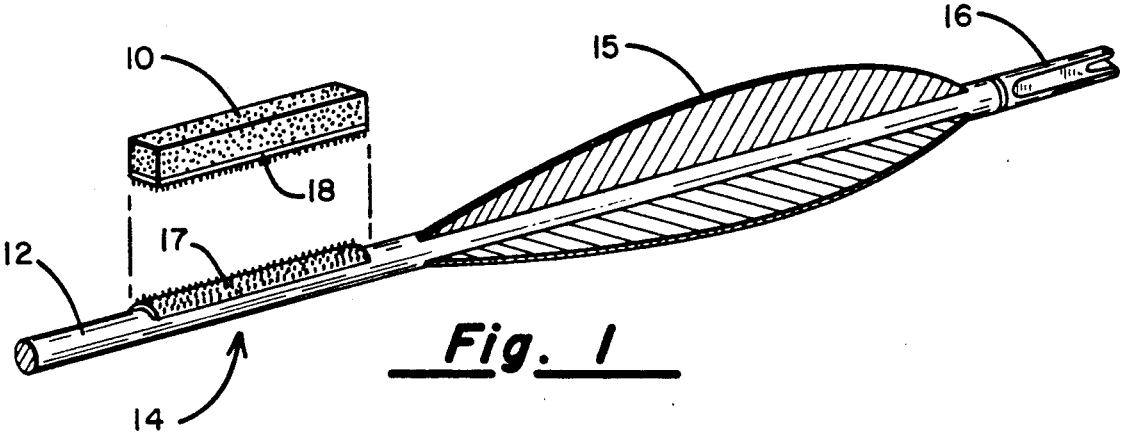
FIG. 1 is a perspective view of the preferred embodiment of the present invention showing the manner of attachment of the carrier to the shaft of an arrow.

As seen in FIG. 1 the present invention includes a carrier 10 for attachment to the shaft 12 of an arrow generally designated 14, and including a fletching 15 and a nock 16 secured to one end of shaft 12. Arrow 14 includes an arrowhead or point, not shown, secured to the end of shaft 12 opposite from nock 16. An arrowhead generally consists of a sharpened metallic point. Modern hunting arrowheads include sharpened blade portions extending from the head, which arrowheads are generally releaseably secured to the arrow shaft. However, it is contemplated that arrows used to distribute scent as described herein would use standard field points rather than the more expensive hunting arrowheads. FIG. 1 discloses a preferred form of the present invention wherein carrier 10 is releasably secured to shaft 12 adjacent or towards the end of shaft 12 to which nock 16 is attached. It is preferable that carrier 10 be secured proximate fletching 15, as shown in FIG. 1, rather than within fletching 15 so as to provide for adequate surface area on shaft 12 for securing carrier 10. Releaseable attachment is best accomplished by the use of a mutually engageable and releasable material such as is represented by the product trademarked Velcro®, wherein a strip 17 of the Velcro® material is permanently secured to arrow shaft 12 and an opposing or cooperating strip 18 of the Velcro® material is permanently secured to carrier 10. Carrier 10 is preferably made from an absorbent felt material, consisting of tightly matted fibers, and is generally about two inches long with the width and height thereof generally equaling the diameter of shaft 12, or approximately one-quarter to three-eighths of an inch. Carrier 10 could also be made of any suitably absorbent material such as natural or synthetic sponge. Velcro® strips 17 and 18 are preferably secured to shaft 12 and carrier 10, respectively, by means of adhesive, although strip 18 can be sewn to carrier 10.

In operation, carrier 10 is secured to shaft 12 by the cooperating engagement of strips 17 and 18 and then saturated with the attractant scent. It will be understood by those of skill in the art that carrier 10 must be secured to the portion of shaft 12 facing away from the hunter's bow when the arrow is placed therein so that carrier 10 will not contact the bow as the arrow is shot therefrom. The hunter can then, using his bow, shoot the arrow in a high arc so that the head or point end thereof embeds into the ground at the desired distance from the hunter's stand. In this manner, the carrier 10 is held off of the ground and the scent can then be effectively dispersed into the air. It will be understood by those of skill in the art that carrier 10 must be secured to the portion of shaft 12 facing away from the hunter's bow when the arrow is placed therein so that carrier 10 will not contact the bow as the arrow is shot therefrom. Also, depending upon the archery skills of the particular hunter the arrow can also be shot so that the arrow embeds in a tree or other suitable object the desired distance above the ground.

It can be appreciated that the carrier 10 is sized in relation to the tightly matted fiber structure thereof to provide for retention therein and release therefrom of an amount of scent necessary to attract and animal over an extended period of time. However, it is contemplated that various weather conditions and/or scent formulations would require carrier 10 to be sized differently. Thus, for example, lack of wind, or a dilute or less aeromatic attractant scent may require that carrier 10 be sized larger than is described herein.

This release of scent over time, as accomplished by the present invention, is in contrast to a prior art arrow as seen in U.S. Pat. No. 3,150,875 to Searles wherein the shaft thereof contains two easily fractured glass chambers containing different liquid chemicals, which upon mixture react chemically to evolve an artificial smoke. The purpose of such device being to provide for the release therefrom over a short period of time of such artificial smoke so as to provide for locating of the arrow at the end of its flight should it miss its target. In addition, such glass chambers are not suitable for carrying and the slow release therefrom of animal attractant scents.

Carrier 10 is designed primarily for the use of liquid scent formulations. However, animal attractant scents are available in powdered, and paste gel formulations as well as in liquid form. Such scents in the paste or gel form can be effectively used with the present invention by application thereof to the exterior surface of carrier 10. It is contemplated that powdered scents could be dissolved with a suitable liquid and then applied to carrier 10.

It can be appreciated that the present invention is most suitable for use by those individuals hunting with a bow and arrow, as very little extra equipment is required other than a few extra arrows to be used for dispersing the scent. However, it can also be appreciated that the present invention can be of utility with elongate projectiles other than arrows. For example, a suitable rigid projectile, not shown, such as a steel, wood or fiberglass rod having a sharpened point end could be used to carry the carrier. Thus, a rifle hunter not having or desiring to carry a bow and arrows, could simply throw the steel rod with the carrier attached to an end thereof opposite the point end so as to embed the point end the projectile with the carrier attached thereto at the desired distance from his position. In addition, it is also contemplated that a device other than a bow such as sling shot could be used to shoot the arrow or other projectile to the desired position. It will be understood by those with skill in the art that a rod or similar elongate projectile would need to be weighted to compensate for the lower velocity of a manually thrown projectile as compared to that of an arrow or other projectile shot from a bow or sling shot, so as to insure that the projectile can be firmly imbedded into the ground.

Figure 2:
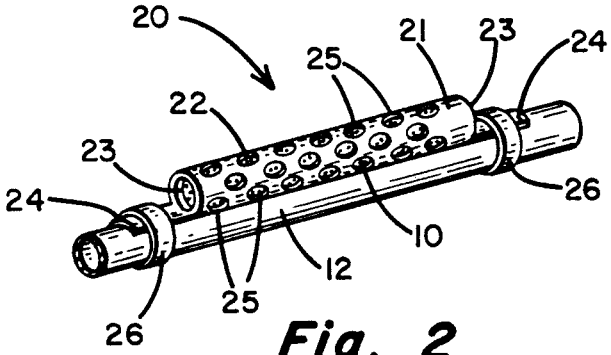
FIG. 2 is a perspective view of an alternative embodiment of the present invention attached to the shaft of an arrow.

An alternate embodiment of the present invention is seen in FIG. 2 wherein a cylindrical container 20 provides for securing of carrier 10 to shaft 12. Container 20 includes an exterior housing 21 defining an interior cavity 22 and end holes 23. Tabs 24 extend from and are integral with housing 21, and housing 21 also includes a plurality of apertures 25. Means 26 for securing container 20 to shaft 12 can include tape or elastic bands extending around tabs 24 and shaft 12. It is also contemplated that screws, not shown, extending through tabs 24 and into shaft 12 could be used as securing means. Container 20 is sized to firmly hold carrier 10 when inserted into cavity 22 through end holes 23, wherein apertures 25 provide for dispersal of the scent from the carrier. Thus, it can be appreciated that either carrier 10 alone, or both container 20 and carrier 10 can be easily removed from shaft 12 when not needed. Also, as previously stated with respect to carrier 10, container 20 must be secured to shaft 12 so that it will not interfere with the bow as arrow 14 is shot therefrom.

Figure 3:
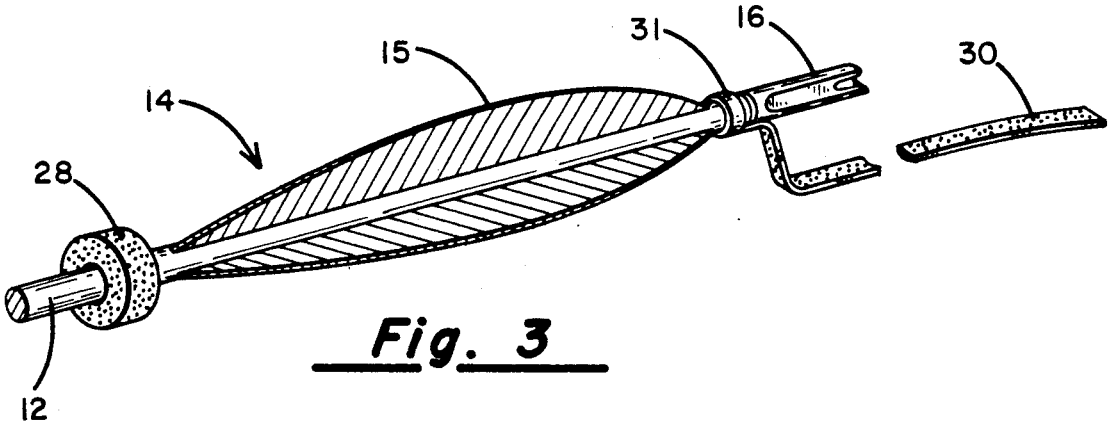
FIG. 3 is a perspective view of two further alternative embodiments of the present invention attached to the shaft of an arrow.

Two other embodiments of the present invention can be seen in FIG. 3 wherein a carrier 28 is circularly shaped having a central aperture that permits snug fitting of carrier 28 around arrow shaft 12. Carrier 28 is made of an absorbent material and is attached to shaft 12 by sliding therealong from the point end, not shown, to the fletching 15. In use carrier 28 would be placed on shaft 12 ahead of the bow to prevent its interference therewith when arrow 14 is shot therefrom. The rapid acceleration of arrow 14 as it is shot from the bow will cause carrier 28 to be positioned adjacent fletching 15. In use carrier 28 would be placed on shaft 12 ahead of the bow to prevent its interference therewith when arrow 14 is shot therefrom. The rapid acceleration of arrow 14 as it is shot from the bow will cause carrier 28 to be positioned adjacent fletching 15, whereby fletching 15 serves to insure that carrier 28 does not come off from arrow 14 during its flight.

In another embodiment of the invention as seen in FIG. 3, a carrier 30 is strip shaped with an end thereof secured to shaft 12 adjacent nock 16. Various means 31 including tape or elastic bands could be used to secure carrier 30 to shaft 12, and thus carrier 30 could be quickly and easily attached to and removed from shaft 12. Carrier 30 can be constructed from a piece of absorbent fabric that has been cut into strips. Carrier 30 would typically be 2 to 6 inches long and approximately ¼ to ⅜ of an inch wide. A strip-shaped carrier would also have the advantage of not appreciably affecting the flight of the arrow and would be easy and inexpensive to make and use.

Figure 4:
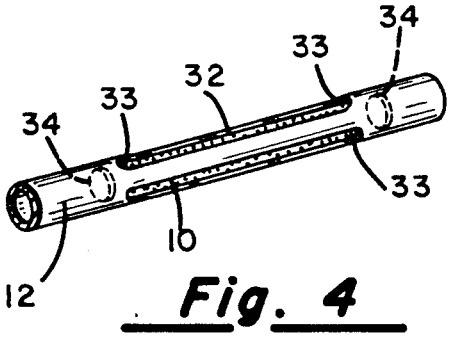
FIG. 4 is a perspective view of a further embodiment of the present invention showing a particularly modified arrow shaft.

FIG. 4 shows a further embodiment of the present invention wherein shaft 12 has been modified to include a recess area 32 therein. As the shafts of modern hunting arrows are generally made from tubular aluminum, carrier 10 or other absorbent material can be inserted into recess area 32 through apertures 33 in shaft 12. Thus, apertures 33 are sized to permit insertion and removal of carrier 10 from the recess area 32 of shaft 12, and to allow dispersal of the scent. Stops 34 can be included within the interior of shaft 12 to prevent unwanted movement of carrier 10 within shaft 12.

Figure 5:
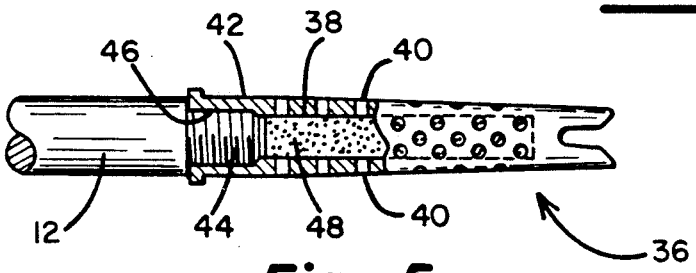
FIG. 5 is a partially cut away elevational view of a further alternative embodiment of the present invention showing a particularly designed arrow nock.

In a further embodiment of the present invention as seen in FIG. 5., a specially designed nock, generally designated 36 is used to secure the carrier to shaft 12. Nock 36 includes an interior cavity 38 and a plurality of holes 40 extending from the surface 42 of nock 36 into cavity 38. Shaft 12 includes a threaded portion 44 for cooperating with a threaded portion 46 of nock 36 for providing releasable securing of nock 36 to arrow shaft 12. When nock 36 is released from shaft 12 it can be appreciated that carrier 48 can be inserted into cavity 38 and when reattached to shaft 12 provides for securing of carrier 48 to arrow 14. Holes 40 would then provide for dispersal of the scent from carrier 48. It is contemplated that such a specially designed nock would be interchangeable with other standard nocks, and thus, lessen any need to use particular arrows solely for scent dispersing purposes.

It can be appreciated that the various embodiments of the present invention as disclosed in FIGS. 2, 3, 4 and 5 could also be easily adaptable to elongate projectiles other than arrows, such as a steel rod as described previously.

It is also contemplated that fletching 15 can itself also serve as a carrier and be formed of a suitable absorbent material, such as a sponge or foam rubber material that can absorb the liquid scent and permit its release therefrom. It is also contemplated that a felt carrier could be secured directly to a standard fletching. Furthermore, it is contemplated that such a fletching could be washable so as to remove the scent if necessary.

While the invention and its various embodiments as described herein contemplate the use primarily of various animal attractant scent formulas, various other scents are known in the art which simulate the scent of predators or human scent and are used to funnel the game away from a particular area towards the position of the hunter. Thus, various hunting related scents can be used with the present invention and provide for either the attracting or repelling of the game as is desired.

What is claimed is:

1. A hunting scent dispersing device, comprising:

a. an arrow, the arrow having a shaft and the shaft having a point end, fletching and a nock end, b. a carrier, made of absorbent material for retaining and for permitting the dispersal therefrom of a hunting scent to be added thereto and dispersed therefrom, and c. attachment means for securing the carrier to the shaft adjacent the fletching and nock end thereof to assure the carrier will be sufficiently held off the ground to allow good dispersal after the arrow has been shot in a high arc and landed on the ground.

2. The hunting scent dispersing device as defined in claim 1, wherein the carrier is ring-shaped having a central aperture for insertion therethrough of the arrow shaft.

3. The hunting scent dispersing device as defined in claim 1, wherein the carrier is strip shaped.

4. The hunting scent dispersing device as defined in claim 1, wherein the attachment means includes mutually engageable and releasable material for providing releasable securing of the carrier to the shaft.

5. The hunting scent dispersing device as defined in claim 1, wherein the attachment means comprises a container secured to the nock end of the shaft, the container having an interior cavity for retention therein of the carrier and the container including at least one aperture for providing insertion of the carrier into the container interior cavity and for facilitating release of the hunting scent from the carrier.

6. The hunting scent dispersing device as defined in claim 1, wherein the attachment means comprises a recess area within the arrow shaft adjacent the nock end thereof for providing retention therein of the carrier and the recess area including at least one aperture for facilitating the release of the hunting scent from the carrier and for providing insertion of the carrier into the recess area.

7. The hunting scent dispersing device as defined in claim 1 wherein the attachment means comprises a nock secured to the nock end of the arrow shaft and the nock including a recess area for providing retention therein of the carrier, and the nock including at least one aperture for providing insertion of the carrier into the nock recess and for facilitating release of the hunting scent from the carrier.

8. The hunting scent dispersing device as defined in claim 7, wherein the nock is releasably secured to the nock end of the arrow shaft.

* * * * *